US009283616B2

(12) United States Patent
Matsukawa

(10) Patent No.: US 9,283,616 B2
(45) Date of Patent: Mar. 15, 2016

(54) GRANULAR BODY GRINDING DEVICE, FOUNDRY SAND RECLAMATION DEVICE, AND PARTICULATE GENERATING DEVICE

(76) Inventor: Yasutsugu Matsukawa, Kishiwada (JP)

( * ) Notice: Subject to any disclaimer, the term of this patent is extended or adjusted under 35 U.S.C. 154(b) by 490 days.

(21) Appl. No.: 13/515,567

(22) PCT Filed: Dec. 16, 2010

(86) PCT No.: PCT/JP2010/072632

§ 371 (c)(1),
(2), (4) Date: Jun. 13, 2012

(87) PCT Pub. No.: WO2011/074628

PCT Pub. Date: Jun. 23, 2011

(65) Prior Publication Data

US 2012/0256026 A1 Oct. 11, 2012

(30) Foreign Application Priority Data

Dec. 18, 2009 (JP) ..... 2009-287696

(51) Int. Cl.

| | |
|---|---|
| ***B22C 5/08*** | (2006.01) |
| ***B22C 5/04*** | (2006.01) |
| *B02C 17/16* | (2006.01) |

(52) U.S. Cl.

CPC . *B22C 5/08* (2013.01); *B22C 5/045* (2013.01); *B02C 17/16* (2013.01); *Y10S 241/10* (2013.01)

(58) Field of Classification Search

CPC ..... B22C 5/04; B22C 5/0436; B22C 5/08; B22C 5/045; B22C 5/0422; B22C 5/00; B22C 5/0404; B22C 5/10; B22C 5/02; B22C 5/18; B24B 11/06; B02C 19/005; B02C 19/0056; B02C 19/068; B02C 17/16; Y10S 241/10

USPC ..... 241/57, 172, 278.1, 284, DIG. 10

See application file for complete search history.

(56) References Cited

U.S. PATENT DOCUMENTS 3,160,998 A * 12/1964 Payne ..... 451/32
4,436,138 A * 3/1984 Kondo ..... 164/5

(Continued)

FOREIGN PATENT DOCUMENTS

DE 199 19 039 A1 11/2000
EP 484532 A1 * 5/1992 ..... B24B 31/10

(Continued)

OTHER PUBLICATIONS

Machine translation of DE 19919039.*

(Continued)

*Primary Examiner* — Alexander P Taousakis
*Assistant Examiner* — Leonel Vasquez
(74) *Attorney, Agent, or Firm* — Buchanan Ingersoll & Rooney PC

(57) ABSTRACT

A granular body grinding device includes a case for containing granular bodies; a drive shaft supported by the case to be rotationally drivable; and a grinding disc having a disc-like disc main body that is fixed on the drive shaft and that is formed with disc surfaces perpendicular to the axial direction of the drive shaft, and formed with a grinding surface at the disc surface of at least one of the disc surfaces on both sides of the disc main body. The grinding device further includes a fluidizing device for fluidizing the granular bodies in a floating state by sending air from the bottom surface portion of the case, to form a fluidized bed in which at least a part of the grinding surface is soaked.

6 Claims, 7 Drawing Sheets

(56) References Cited

U.S. PATENT DOCUMENTS

| | | | | |
|---|---|---|---|---|
| 5,515,907 | A * | 5/1996 | Boenisch | 164/456 |
| 5,769,331 | A * | 6/1998 | Yamagishi et al. | 241/5 |
| 6,401,798 | B1 | 6/2002 | Kondo | |
| 7,374,116 | B2 * | 5/2008 | Ishikawa et al. | 241/171 |

FOREIGN PATENT DOCUMENTS

| | | | |
|---|---|---|---|
| JP | 7-80594 | A | 3/1995 |
| JP | 2000-176598 | A | 6/2000 |
| JP | 2004-261825 | A | 9/2004 |
| JP | 2008-30120 | A | 2/2008 |

OTHER PUBLICATIONS

Extended European Search Report dated Apr. 22, 2013, issued by the European Patent Office in the corresponding European Application No. 10837653.4. (6 pages).

International Search Report (PCT/ISA/210) issued on Mar. 15, 2011, by the Japanese Patent Office as the International Searching Authority for International Application No. PCT/JP2010/072632.

* cited by examiner

GRANULAR BODY GRINDING DEVICE, FOUNDRY SAND RECLAMATION DEVICE, AND PARTICULATE GENERATING DEVICE

TECHNICAL FIELD

The present invention relates to a grinding device for granular bodies. Further, it relates to a reclamation device for foundry sands applying the grinding device thereto and a generating device for particulates obtained by crushing parts of material granular bodies.

BACKGROUND ART

A granular body grinding device is for grinding surfaces of granular bodies being in the form of sands and is for generating grinding powder being particulates which are generated by removing extraneous matters adhering to the surfaces of granular bodies or by grinding material granular bodies. As one applying the granular body grinding device thereto, there has been known a device that makes foundry sands reusable by removing coal powder and resin adhering to the surfaces of used foundry sands. For example, a foundry sand reclamation device described in Patent Document 1 is provided with a plurality of grinding wheels mounted in juxtaposition on the same drive shaft and a drum for scooping up foundry sands in the device. In the device, the foundry sands charged into the device are scooped up by the drum above the rotating grinding wheels and are repetitively ground on the circumferential surfaces being grinding surfaces of the grinding wheels.

Further, a foundry sand reclamation device in Patent Document 2 is provided with a rotor formed with inclined rough surfaces (grinding surfaces) on its rotating surface and a mixing tub that forms a fluidized bed of foundry sands inside thereof by blasting air from a blower, as described in paragraphs [0041], [0042] and FIG. 2. In the device, the foundry sands charged into the device are fluidized in the mixing tub and are ground by being collided with the rough surfaces of the rotationally driven rotor. As described above, the devices in Patent Documents 1 and 2 perform the removals of extraneous matters on the foundry sands by grinding the surfaces of the foundry sands.

PRIOR ART DOCUMENTS

Patent Documents

Patent Document 1: JP2004-261825 A
Patent Document 2: JP2008-30120 A

SUMMARY OF THE INVENTION

Problems to be Solved by the Invention

However, in the device described in Patent Document 1, the replacements of the grinding wheels become difficult because the grinding wheels for grinding the foundry sands are heavy loads, and the maintainability is poor because the balancing adjustment is required. Further, it may occur that due to its structure, the foundry sands reside in clearances at various parts and thus, an anxiety arises in that the foundry sands may be discharged without being subjected to the reclamation process.

Further, in the device described in Patent Document 2, the rotor is oscillated in order to bring the foundry sands into collision with the grinding surfaces at a predetermined angle. Where the foundry sands are brought into collision with the grinding surfaces at an angle in this manner, abrasive grains forming the grinding surface become liable to separate therefrom, which results in the deterioration of the grinding tool. Further, the construction that oscillates the rotor causes the balancing adjustment of the rotor to be difficult, also brings about vibration in the device with an increase in the rotation of the rotor, and thus, makes a primary factor of being unable to sufficiently heighten the process efficiency.

Further, in the aforementioned prior art devices, it is done for an increase in the process quantity to strengthen the friction force of the foundry sands with the grinding wheel or to bring the foundry sands into strong collision with the grinding surface. In this occasion, it occurs that the foundry sands being granular bodies are crushed by friction resistance or impact. This gives rise to an anxiety that the reclaimed foundry sands are deteriorated in quality though the extraneous matters are removed from the foundry sands.

The present invention has been made with the foregoing problems taken into consideration, and an object thereof is to provide a granular body grinding device capable of grinding granular bodies efficiently and excellently and to provide a foundry sand reclamation device and a particulate generating device which apply the granular body grinding device thereto.

Measures for Solving the Problems

In order to solve the foregoing problems, a granular body grinding device according to the present invention comprises a case for containing granular bodies; a drive shaft supported by the case to be rotationally drivable; a grinding disc having a disc-like disc main body that is fixed on the drive shaft and that is formed with disc surfaces perpendicular to an axial direction of the drive shaft, and formed with a grinding surface at the disc surface of at least one of the disc surfaces on both sides of the disc main body; and fluidizing means for fluidizing the granular bodies in a floating state by sending air from a bottom surface portion of the case, to form a fluidized bed in which at least a part of the grinding surface is soaked.

In the present invention, there may be taken a construction that the thickness of the disc main body relative to the diameter of the disc main body is 0.04 or less.

In the present invention, the fluidizing means may be configured to form the fluidized bed so that the drive shaft is soaked in an upper region of the fluidized bed.

In the present invention, there may be taken a construction that the drive shaft is rotationally driven so that the circumferential speed of the rotating grinding disc becomes 1000 m/min or higher In the present invention, there may be taken a construction that is provided with a plurality of the drive shafts supported by the case and a plurality of the grinding discs respectively arranged on the plurality of drive shafts.

In the present invention, there may be taken a construction that the drive shaft is supported by the case to be rotationally drivable with one end side only held in a cantilever fashion.

In the present invention, there may be taken a construction that is further provided with a collision member arranged inside the case at a position above the fluidized bed for colliding with some of the granular bodies that are scattered above the fluidized bed as a result of the granular bodies being ground by the rotational driving of the grinding disc.

In the present invention, the same may be a foundry sand reclamation device wherein the granular bodies are foundry sands and wherein the grinding disc grinds surfaces of the foundry sands to remove extraneous matters on the foundry sands.

In the present invention, the same may be a particulate generating device wherein the granular bodies are material granular bodies and wherein the grinding disc grinds surfaces of the material granular bodies to generate particulates from the material granular bodies.

Effects of the Invention

According to the invention, the granular body grinding device is configured to be provided with the drive shaft, the grinding disc fixed on the drive shaft, and the fluidizing means for fluidizing the granular bodies in the floating state by sending air from the bottom surface portion of the case, to form the fluidized bed. The fluidizing means forms the fluidized bed to soak therein at least the part of the grinding surface of the grinding disc. Further, the disc-like disc main body is fixed on the drive shaft and is formed with the disc surfaces perpendicular to the axial direction of the drive shaft. That is, the grinding surface formed on the disc surface of the disc main body is made to be perpendicular to the axial direction of the drive shaft.

In the construction like this, when the grinding disc is rotationally driven by the drive shaft, the periphery of the grinding disc falls in a negative pressure relative to the fluidized bed. Therefore, of the granular bodies being fluidized in the fluidized bed in the floating state, those adjacent to the grinding surface of the grinding disc are urged toward the grinding surface by the negative pressure which is generated on the grinding surface by the rotational driving of the grinding disc. As a result, the granular bodies urged toward the grinding surface are ground in contact with the grinding surface.

At this time, it takes place that due to grinding resistance in grinding, the granular bodies are scattered in the circumferential direction of the grinding disc by being subjected to a force in the tangential directions at portions of the grinding surface that they contact. Then, because the grinding surface of the grinding disc is formed to be perpendicular to the axial direction of the drive shaft, the scattered granular bodies are continuously urged toward the grinding surface due to the negative pressure generated on the grinding surface while flying around the grinding surface in the fluidized bed. Thus, the granular bodies are ground in contact with the grinding surface as they are moved in the outer circumferential direction.

Further, in the construction like this, the disc main body of the grinding disc is fixed on the drive shaft to be perpendicular to the axial direction of the drive shaft. Thus, it becomes possible that the grinding disc is rotationally driven without oscillating as a whole. That is, since the grinding disc is rotationally driven with itself having been adjusted in balance, the granular body grinding device is able to rotationally drive the grinding disc at a high speed and is able to generate an excellent negative pressure on the grinding surface. Therefore, by rotationally driving the grinding disc being a grinding tool at a suitable speed, the granular body grinding device can perform the grinding process with the granular bodies being urged toward the grinding surface by the negative pressure without being brought into collision with the grinding surface in comparison with that in the prior art.

In the foundry sand reclamation device described in Patent Document 2, the collisions of the grinding surface with the foundry sands are positively urged by oscillating the rotor relative to the foundry sands floating in the fluidized bed. Even in this construction, it is deemed that the rotation of the rotor causes a negative pressure to be generated. However, the granular bodies are brought into collision with the grinding surface by an mixing-dependant action resulting from the oscillation of the rotor or from the air blowing rather than by the urging toward the grinding surface due to the negative pressure.

In the granular body grinding device of the present invention, on the contrary, the granular bodies are urged toward the grinding surface by utilizing the pressure which is exerted on the granular bodies by the negative pressure generated on the grinding surface of the grinding disc rotationally driven in the fluidized bed. To be more precise, the force in the normal direction thereof, that is, the force in the rotational axis direction of the grinding disc which force is exerted on the grinding surface when the granular bodies contact the grinding surface becomes relatively small. Thus, it results that the force in the rotational axis direction which is exerted as a reaction force on the granular bodies is also small. In the foundry sand reclamation device in the prior art, the friction resistance or the impact causes a large force to be exerted on the foundry sands, and hence, an anxiety arises in that the foundry sands are crushed and are deteriorated in quality. In contradistinction to this, in the present invention, because the force exerted on the granular bodies is small, the crushing or the like of the granular bodies in the grinding process can be prevented, so that the granular bodies after the grinding process can be enhanced in quality.

Further, in the grinding process, the force exerted on the grinding surface in the rotational axis direction is small, and thus, where the grinding surface is formed with, for example, abrasive grains, the force that is exerted to separate the abrasive grains from the grinding surface becomes small. Therefore, it is possible to prevent the separation of the abrasive grains and to prevent the deterioration of the grinding disc being a grinding tool. On the other hand, the difference in relative speed between the granular bodies and the grinding surface can be made to be large by rotationally driving the grinding disc at a high speed, so that a sufficient grinding capability can be obtained.

Further, in the present invention, the thickness of the disc main body relative to the diameter of the disc main body in the grinding disc is set to be 0.04 or less in ratio. However, in the conventional grinding wheel for grinding foundry sands, since the thickness of the grinding wheel relative to the diameter of the grinding wheel is, for example, ⅙ or so, the ratio is about 0.17. The conventional grinding wheel like this is a heavy load in itself. On the contrary, in the present invention, by being set to be sufficiently thin relative to the diameter, the grinding wheel can be made light in comparison with the conventional grinding wheel.

A torque load is applied to the drive shaft in grinding the granular bodies in the operation of the granular body grinding device. This torque load fluctuates in dependence on the state of the fluidized bed with the drive shaft soaked therein, the circumferential speed of the grinding disc and the like and largely influences the power consumption. Further, it was grasped that in grinding the granular bodies with the conventional grinding wheel, the torque load applied to the drive shaft increased proportionally as the fluidized bed was deepened. On the other hand, by making the grinding disc thin, an increase in the torque load applied to the drive shaft as the fluidized bed is deepened can be restrained in comparison with that in the convention grinding wheel. Therefore, the granular body grinding device is able to suppress the power consumption in the grinding process. Further, since thinning the grinding disc makes it possible to set the circumferential speed of the grinding disc to be high and to permit a high speed rotation, it is possible to increase the negative pressure generated on the grinding surface of the grinding wheel.

Accordingly, the granular bodies urged toward the grinding surface by the negative pressure can be increased, so that the process efficiency in grinding can be improved.

Further, according to the present invention, the fluidizing means is configured to form the fluidized bed so that the drive shaft is soaked in the upper region of the fluidized bed. To be more exact, the granular bodies in the fluidized bed are blown up by the air blowing of the fluidizing means to the vicinity of the axis center of the rotating grinding disc. At this time, an upper portion side of the grinding disc is in the state of being not soaked in the fluidized bed. The granular bodies having been ground in the fluidized bed are scattered by being subjected to the force in the tangential directions at the contact portions on the grinding surface. Where the scattering direction of the granular bodies is directed toward a deep region side of the fluidized bed, the granular bodies come into collision with the inner wall of the case, other granular bodies and the like as they are influenced by the air blowing of the fluidizing means. Where the scattering direction of the granular bodies is directed toward a surface region side of the fluidized bed, on the contrary, the granular bodies come out of the fluidized bed and scatter inside the case.

Further, in the granular body grinding device like this, it is necessary to collect the ground granular bodies and the grinding powder produced by the grinding. Thus, in the grinding process, such collection is carried out by making the granular bodies scatter from the fluidized bed and by discharging the grinding powder from the fluidized bed together with the scattering of the granular bodies. That is, by taking the aforementioned construction, it is possible to grind the granular bodies and to scatter some of the plurality of ground granular bodies above the fluidized bed. Thus, the granular body grinding device is able to easily collect the grinding powder. Further, some of the granular bodies come out of the fluidized bed and come back again into the fluidized bed, so that the circulation of the granular bodies in the fluidized bed can be facilitated. Therefore, the granular body grinding device is able to decrease unprocessed granular bodies in the grinding process.

Further, according to the present invention, the drive shaft is rotationally driven so that the circumferential speed of the rotating grinding disc becomes 1000 m/min or higher. The circumferential speed of the grinding disc is the rotational speed per unit time at a largest radius portion which is located on the outermost side of the grinding surface formed on the disc main body. Although the granular body grinding device is improved in the process efficiency of grinding as the circumferential speed of the grinding disc is increased, setting the circumferential speed to be high results in a large power consumption. However, as a result of grinding the granular bodies at various circumferential speeds, it was found out that although varying in dependence on the density of the granular bodies, the atmospheric pressure and the like in the fluidized bed, the process efficiency of grinding increased at a predetermined rate until the circumferential speed of the rotating grinding disc reached 1000 m/min, but did not increase at the predetermined rate even if the circumferential speed was increased to be higher than that. Therefore, in the present invention, by taking the foregoing construction, it is possible to heighten the efficiency in grinding process and to suppress the power consumption. Further, in the case of the conventional grinding wheel, it is difficult in light of the relation to weight to set the circumferential speed to 1000 m/min or higher in the state that the drive shaft is soaked in, for example, the upper region of the fluidized bed. However, because by being thinned, the grinding disc becomes light in weight and can be driven stably, it is possible to set the circumferential speed to be high. Further, by setting the circumferential speed to 1000 m/min or so, the process efficiency of grinding can be enhanced.

Further, according to the present invention, there is taken a construction that the plurality of grinding discs are respectively arranged on the plurality of drive shafts. The process quantity in the grinding process changes in dependence on the density of the granular bodies included in the fluidized bed, the circumferential speed of the grinding disc, the area of the grinding surface of the grinding disc soaked in the fluidized bed, and the like. Thus, by taking the construction that the granular body grinding device is provided with the plurality of grinding discs, it is possible to increase the area of the grinding surfaces soaked in the fluidized bed. This increases the number of the granular bodies contacting the grinding surfaces in the fluidized bed, so that the process quantity in the grinding process is increased to enhance the process efficiency. Further, it is desirable that the plurality of grinding discs are arranged with a predetermined space therebetween. The term "predetermined space" means the distance between adjoining grinding discs in the case that the plurality of grinding discs are set to be rotatably supported by the case without contacting one another. Further, the predetermined space may be suitably set taking into consideration the diameter and thickness of the grinding discs, the state of the fluidized bed formed by the fluidizing means, and the like.

Further, the plurality of drive shafts with the grinding discs fixed thereon are arranged at positions where their axial directions are shifted with each other in a horizontal direction or in a vertical direction. In this case, the plurality of grinding discs are arranged in parallel, so that the area of the grinding surfaces soaked in the fluidized bed can be increased. This makes it possible to increase the process quantity in the grinding process to enhance the process efficiency. Further, by suitably arranging the plurality of grinding discs in the case, it is possible to adapt the granular body grinding device for its configuration such as various shapes of the case, the state of the fluidized bed and the like.

The granular body grinding device takes a construction that a charge port for granular bodies is provided on one end side of the case and a discharge port for granular bodies is provided on the other end side opposite to the charge port. In this construction, it may be the case that the grinding process is set to a continuous mode wherein per unit time, a predetermined quantity of granular bodies are charged from the charge port into the case and the granular bodies are discharged from the discharge port. In such a case, by providing the plurality of grinding discs with the predetermined space therebetween at least in the horizontal direction, the grinding state of the granular bodies in the fluidized bed is made to change from one end side to the other end side. Thus, unprocessed granular bodies are prevented from being mixed with the discharged granular bodies, so that an excellent grinding process can be performed as a whole.

Further, it may be the case that the grinding process is set to a batch mode wherein the granular bodies of a predetermined quantity is charged into the case to be subjected to a grinding process for a predetermined time, after which the granular bodies contained in the case are discharged. In such a case, by providing the plurality of the grinding discs with a predetermined space therebetween in the vertical direction, the fluidized bed can be set to be deep. Thus, the containable volume of the case is utilized effectively, so that the process quantity of the grinding process in the fluidized bed can be increased without enlarging the diameter of the grinding discs. Besides, where the fluidizing means is configured to form the fluidized bed so that the drive shafts are soaked in the upper region of the fluidized bed, the aforementioned construction may be applied to some of the grinding discs of the plurality of grinding discs.

Further, according to the present invention, the drive shaft may be one that is supported by the case to be rotationally drivable with one end side only thereof held in a cantilever fashion. The drive shaft is supported by a bearing in the case to be rotationally drivable. However, since the conventional grinding wheel in the prior art is a heavy load and involves a risk of bending the drive shaft due to its dead load, the drive shaft is usually supported at both ends by bearings in the case. Further, as is the case of the foundry sand reclamation device described in Patent Document 2, the rotor is oscillated in order to positively collide the grinding surface with the floating foundry sands. In this construction, an anxiety arises in that the oscillation causes the vibration of the drive shaft to increase with an increase in the rotational speed of the drive shaft.

On the contrary, in the granular body grinding device of the present invention, the grinding disc that is thin in comparison with the conventional grinding wheel is fixed to become perpendicular to the axial direction of the drive shaft. Thus, the grinding disc and the drive shaft can be stabilized in operation without causing the grinding surface to oscillate in the driving state of the granular body grinding device. Thus, as is the case of the present invention, it is possible to take a construction that the drive shaft is supported by the case with its one end side only held in a cantilever fashion. Like this, being a cantilever support of the drive shaft with the grinding disc fixed thereon make it possible that in replacing the worn-out grinding disc, the detaching/attaching of the grinding discs can be done from the other end side on which the drive shaft is not supported by the case. Thus, in comparison with those devices in which as is the case of the prior art, the replacement of the grinding wheel is done with the drive shaft having come out off a bearing on at least one end side, the work load at the replacement step can be reduced greatly. Therefore, it is possible to improve the maintainability of the granular body grinding device. Further, because the bearing in the case suffices to be arranged on one end side only of the drive shaft, the components can be reduced in number in comparison with those in the case of supports on both end sides. Further, where the ratio of the thickness to the diameter of the disc main body is set to 0.04 or less, the device can be further stabilized in operation, and hence, the drive shaft can be configured to be supported in a cantilever fashion.

Further, according to the present invention, a collision member for colliding with some of the granular bodies that are scattered above the fluidized bed by being ground with the grinding disc is configured to be arranged inside the case at a position above the fluidized bed. When the granular bodies are ground in the fluidized bed by the grinding surface of the grinding disc, grinding powder is produced from the granular bodies. It may occur that the grinding powder floating in the fluidized bed adheres again to the surfaces of the granular bodies due to static electricity. Therefore, by providing the collision member that collides with the granular bodies scattered above the fluidized bed, it is possible to separate the grinding powder adhering to the granular bodies on the impact of collision. Further, by suitably setting a collision surface of the collision member, the granular bodies having been separated from the grinding powder are returned into the fluidized bed, and hence, the circulation of the granular bodies in the fluidized bed can be facilitated.

Further, according to the present invention, the foundry sand reclamation device takes the construction that the granular body grinding device is applied to the foundry sand reclamation device so that the grinding disc grinds the surfaces of foundry sands to remove extraneous matters of the foundry sands. In the foundry sand reclamation device, the granular bodies are used foundry sands, and the extraneous matters such as coal powder, resin and the like adhering to the surfaces of the foundry sands are removed to reclaim the foundry sands.

As the foundry sand reclamation devices in the prior art, there is one for example in which a grinding wheel is rotationally driven to repetitively grind foundry sands on the circumferential surface of the grinding wheel. Further, besides, as the prior art foundry sand reclamation devices, there is one in which a fluidized bed of foundry sands is formed inside a mixing tub and in which the grinding is carried out to collide the foundry sands and the grinding surface by rotationally driving a rotor whose grinding surface oscillates, in the fluidized bed. In the foundry sand reclamation device like this, there was a problem that the rotational driving of the grinding wheel being a grinding tool or the rotor was not able to be sufficiently heightened in speed in viewpoints of the balancing adjustment and the vibration. Further, a problem also arose in that the grinding tool was liable to deteriorate because the force that the foundry sands exerted on the grinding tool in the normal direction was large.

On the contrary, the foundry sand reclamation device applying thereto the granular body grinding device according to the present invention is configured to grind the foundry sands by rotationally driving the grinding disc in the fluidized bed which the fluidizing means forms to fluidize the foundry sands in a floating state. Then, the grinding surface of the grinding disc being a grinding tool is formed to become perpendicular to the axial direction of the drive shaft. Thus, the grinding disc can be rotationally drive at a high speed because of becoming a well-balanced member that does not oscillate as a whole and because of becoming light in weight. Therefore, the process efficiency in grinding can be enhanced.

Further, according to the present invention, the particulate generating device takes the construction that the granular body grinding device is applied to the particulate generating device so that the grinding disc grinds the surfaces of the material granular bodies to generate the particulates from the material granular bodies. The particulate generating device takes the granular bodies as the material granular bodies for the particulates and crashes parts of the surfaces of the material granular bodies to generate the particulates.

As the prior art particulate generating devices, as described in JP 2006-51496 A for example, there is known a jet mill (jet crusher) in which charged material granular bodies are brought by a collision stream such as jet stream into collision with a collision plate to be crushed. Thus, the material granular bodies are machined to those of a predetermined grain size, and the generated particulates are utilized as various industrial materials. However, in such a crusher, the crushing is carried out by colliding the material granular bodies with the collision plate or the material granular bodies with one another. Therefore, of the kinetic energy that the material granular bodies are given by the jet stream or the like, the energy that is effectively utilized for crushing is small in quantity, and the loss in energy is large. Further, since the air including the material granular bodies moves in the interior of the main body at a high speed, the abrasion of the interior of the main body is large, and the maintainability is low. In addition, conventional crusher machines repeat crushing to make the material granular bodies to a predetermined grain size, and it is sometime the case that the smaller the desired grain size is, the lower the crushing efficiency becomes or the worse the suitability for a small quantity production becomes.

On the contrary, the foundry sand reclamation device applying thereto the granular body grinding device according to the present invention is configured to grind the material granular bodies by rotationally driving the grinding disc in the fluidized bed which the fluidizing means forms to fluidize the material granular bodies in the floating state. Then, the grinding surfaces of the grinding disc being a grinding tool are formed to be perpendicular to the axial direction of the drive shaft. Then, the particulate generating device urges the material granular bodies toward the grinding surfaces by utilizing the pressure that is exerted on the material granular bodies due to the negative pressure generated on the grinding surfaces of the grinding disc being rotationally driven in the fluidized bed. Therefore, in the particulate generating process by the grinding process, the force exerted on the grinding surfaces in the rotational axis direction becomes relatively small. The grinding powder produced by such grinding process can be made to be very fine in comparison with that in the prior art. The grinding powder is the particulars that are produced as a result that parts of the material granular bodies are crushed in contacts of the surfaces of the material granular bodies with the grinding surfaces.

That is, by taking the aforementioned constructions, it is possible to collect the particulates generated by crushing the parts of the material granular bodies and to obtain the particulates efficiently. Further, although the prior art crusher machine makes the grain size of the material granular bodies smaller gradually by repeating the crushing, the particulate generating device is able to generate the particulates as fine grinding powder from the early stage of the operation of the particulate generating device. Thus, since the particulate generating process can be performed to meet a required quantity of the particulates, the device is high in production efficiency and is suitable for a small-volume production. Further, it is possible to adjust the grain size of the particulates by properly setting the grain size of abrasive grains forming the grinding surfaces, the circumferential speed of the grinding disc, the state of the fluidized bed by the fluidizing means, the atmospheric pressure in the case, and the like.

BRIEF DESCRIPTION OF THE DRAWINGS

FIG. 5(*a*) shows those before the grinding process, and FIG. 5(*b*) shows those after the grinding process.

FORMS FOR IMPLEMENTING THE INVENTION

Hereinafter, embodiments concretizing a granular body grinding device of the present invention will be described with reference to the drawings.

<First Embodiment>

(Construction of Foundry Sand Reclamation Device 1)

Figure 1:
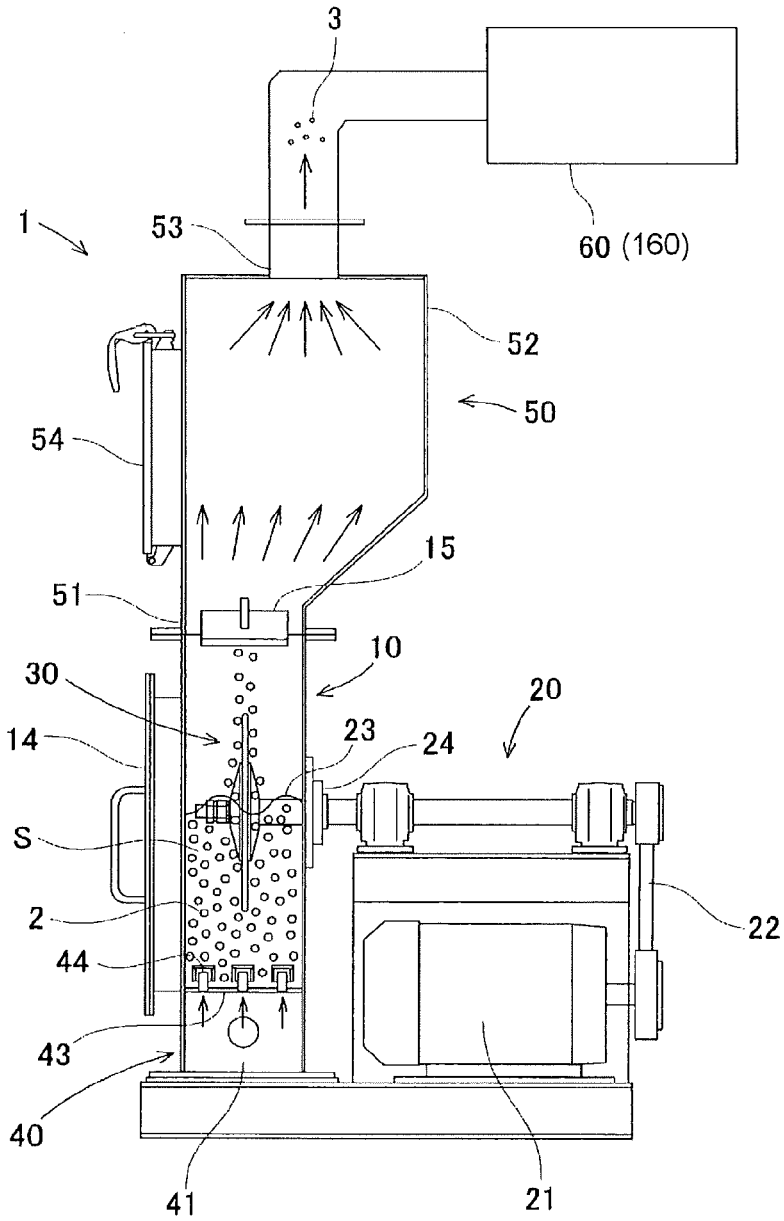
[FIG. 1] is a general view showing a foundry sand reclamation device in a first embodiment.
Figure 2:
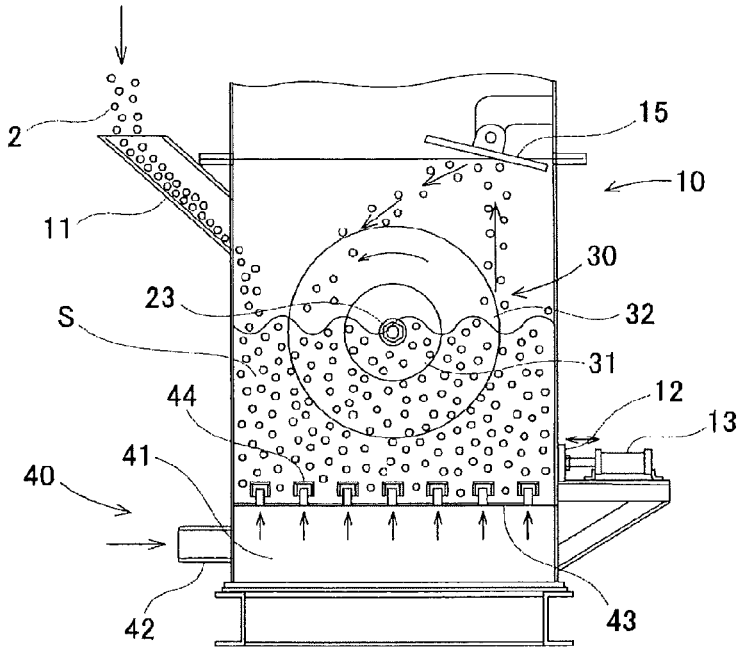
[FIG. 2] is a front view showing the interior of a grinding tub.
Figure 3:
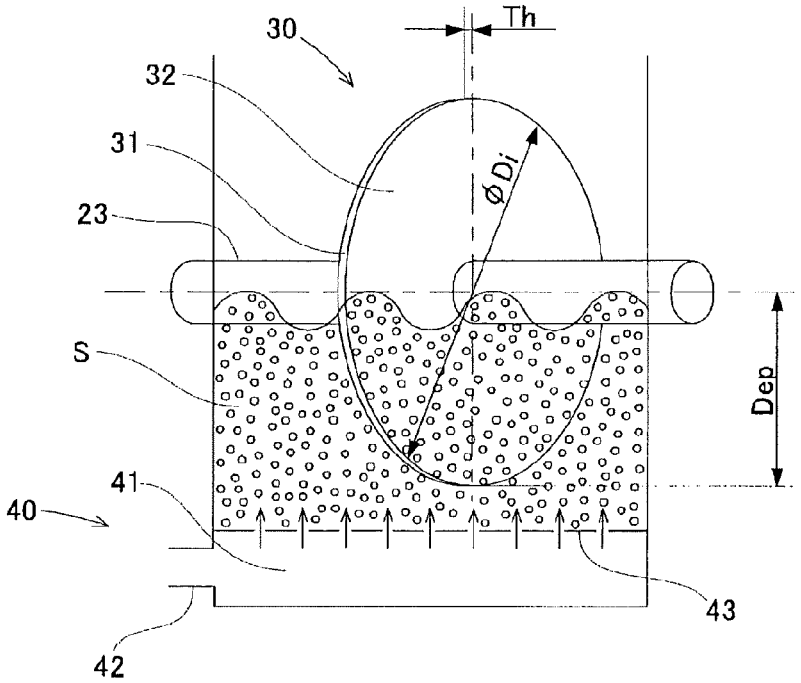
[FIG. 3] is an explanatory view for a grinding process.

A foundry sand reclamation device 1 in a first embodiment to which the granular body grinding device of the present invention is applied will be described with reference to FIGS. 1-3. FIG. 1 is a general view showing the foundry sand reclamation device 1. FIG. 2 is a front view showing the interior of a grinding tub 10. FIG. 3 is an explanatory view for a grinding process.

As shown in FIGS. 1 and 2, the foundry sand reclamation device 1 is composed of the grinding tub 10, a driving device 20, a grinding disc 30, a fluidizing device 40, an inactivating tub 50, and a dust collector 60. The foundry sand reclamation device 1 is for removing, by a grinding process, extraneous matters 3 such as coal powder, resin and the like adhering to the surfaces of used foundry sands 2 to reclaim the foundry sands 2. The foundry sands 2 are sands used to make sand molds in manufacturing castings and are collected by crushing the sand molds after the use as sand molds. The surfaces of the used foundry sands 2 so collected have adhered thereto extraneous matters 3 such as combustible material, volatile constituent and the like that contain a binder used at the time of manufacturing the sand molds. Because the foundry sands 2 with the extraneous matters 3 adhering thereto cannot be reused as foundry sands, it is necessary to remove the extraneous matters 3.

The method of reclaiming foundry sands is classified roughly into a dry process (mechanical type), a wet process and a roast process. Of these, the dry process is widely used in terms of being relatively simple in device construction as well as of the facility cost. Furthermore, the dry process reclamation method is classified by the way of removing (separating) the extraneous matters, into impact type, friction type and grinding type. The impact type aims at removing the extraneous matters by bringing the foundry sands into collisions with one another or with a target (a collision board or a rough surface), and is the method that is used by the device described in Patent Document 2. The friction type aims at separating the extraneous matters by rubbing sands with one another.

The grinding-type reclamation method aims at removing the extraneous matters by grinding (abrading) the surfaces of sands being granular bodies. As a result of evaluating the aforementioned dry-type reclamation method in a viewpoint of the capability of separating extraneous matters, it is known that the grinding type is remarkably higher in energy efficiency for separation than the impact type and the friction type. Therefore, the foundry sand reclamation device 1 of the present invention aims at improving the quality of reclaimed sands and the reclamation efficiency by utilizing a granular body grinding device that adopts the grinding type reclamation method, and hence, by increasing the process quantity in the grinding process. Further, grinding the surfaces of foundry sands 2 by the foundry sand reclamation device 1 causes some of the extraneous matters 3 to be separated and become fine powder dust 4. The fine powder dust 4 is grinding powder produced by the grinding process.

The grinding tub 10 is a case having a charge port 11, a discharge port 12, an air cylinder 13, a sight glass 14, and a collision plate 15 and containing therein foundry sands being granular bodies. The grinding process of the foundry sands 2 is carried out in the interior of the grinding tub 10. As shown in FIG. 2, the charge port 11 is an opening portion formed to extend from a side surface on one side of the grinding tub 10 to be slanted upward and enables used foundry sands 2 to be charged into the grinding tub 10. The discharge port 12 is an openable door formed to be openable and closable on a side surface on the other side of the grinding tub 10 and enables reclaimed foundry sands 2 to be discharged to the outside of the grinding tub 10 after completion of the grinding process.

The discharge port 12 may be set to make its lowermost portion spaced by a predetermined distance from a bottom portion of the grinding tub 10. In the grinding process by the foundry sand reclamation device 1, it may occur that of the charged foundry sands 2, unprocessed foundry sands 2 stay at the bottom portion of the grinding tub 10 without being sufficiently ground. In this case, for example, the position of the lowermost portion of discharge port 12 is set to a higher position than the height of the unprocessed foundry sands 2 that accumulate at the bottom portion of the grinding tub 10. Thus, in discharging the reclaimed foundry sands 2 from the discharge port 12, it is possible to prevent the unprocessed foundry sands 2 from being discharged in the state of being mixed with the reclaimed foundry sands 2.

The air cylinder 13 is arranged outside the grinding tub 10 and on an outer surface side of the discharge port 12 and opens and closes the discharge port 12 by an air pressure supplied by the manipulation of the worker. As shown in FIG. 1, the sight glass 14 is an openable door formed to be openable and closable at the front part of the grinding tub 10 and having a transparent window portion. Through the sight glass 14, it is possible to observe the state of the grinding process and to perform the replacement work of a grinding disc 30 referred to later. The collision plate 15 is a plate-like collision member arranged in the interior of the grinding tub 10 to be located above the fluidized bed S referred to later. The collision plate 15 is appropriately set in position, angle and the like to be collided with some of the foundry sands 2 that are scattered above the fluidized bed S in the grinding process.

The driving device 20 is a device having an electric motor 21, a driving force transmission device 22, a drive shaft 23, and a bearing 24 for rotationally driving the grinding disc 30 referred to later at a predetermined rotational speed. The electric motor 21 is fixed on a mounting table and is a power supply which outputs a driving force by being supplied with required electric power. The driving force outputted from the electric motor 21 is transmitted to the drive shaft 23 through the driving force transmission device 22. The driving force transmission device 22 has a reduction mechanism (not shown) and transmits the driving force so that the drive shaft being an output shaft is rotationally driven with the rotational speed of the electric motor 21 regulated to a predetermined rotational speed.

In the present embodiment, the rotational speed of the drive shaft 23 is regulated so that the circumferential speed of the grinding disc 30 referred to later becomes 1470 [m/min]. The circumferential speed of the grinding disc 30 is the rotational speed per unit time at the maximum radius portion which is located on the outmost side on the grinding surfaces 32 formed on the disc main body 31. The drive shaft 23 is supported by the grinding tub 10 to be rotationally drivable through the bearing 24 placed at a back surface of the grinding tub 10. The bearing 24 is a bearing mechanism for supporting a rotating drive shaft. In this manner, the drive shaft 23 is supported by the grinding tub 10 being the case of the foundry sand reclamation device 1 to be rotationally drivable with its one end side only held in a cantilever fashion.

The grinding disc 30 has the disc main body 31 and the grinding surfaces 32 and is a grinding tool in the grinding process of the foundry sand reclamation device 1. The disc main body 31 is a disc-like member formed to have a predetermined board thickness. The disc main body 31 is fixed by an attaching fixture on the drive shaft 23 with its disc surfaces being perpendicular to the axial direction of the drive shaft 23. That is, when the drive shaft 23 is rotationally driven, the disc surfaces of the disc main body 31 are rotated without oscillating relative to the drive shaft 23. Now, as shown in FIG. 3, let Di be assumed as the diameter of the disc main body 31 and Th be assumed as the thickness of the disc main body 31. In the present embodiment, the disc main body 31 is set to make the ratio of the thickness Th to the diameter Di become 0.025. More specifically, the diameter Di is set to 360 [mm] and the thickness Th is set to 9 [mm].

The grinding surfaces 32 are so formed that numerous fine abrasive grains are bonded on the disc surfaces on both sides of the disc main body 31 for grinding the surfaces of foundry sands 2 contacted therewith. In the present embodiment, steel is used as the material of the disc main body 31, and the abrasive grains made of diamond are bonded on the disc surfaces of the disc main body 31 by the electrodeposition method. Besides, the disc main body 31 may be made of a material such as, for example, ceramics or the like. Further, the abrasive grains may be made of a material such as, for example, CBN (cubic boron nitride) or the like and may be bonded on the disc main body 31 by a bonding method using, for example, a metal powder, a vitreous material, a heat-resistance highly-functional resin or the like, as well as by the electrodeposition method. Further, although the grinding surfaces 32 suffice to be formed on the disc-like surface on at least one side of the disc-like surfaces on both sides of the disc main body 31, they are preferably formed on the both surfaces in view of the process efficiency in grinding. In the present embodiment, the grinding surfaces 32 are formed by bonding the aforementioned abrasive grains on portions of the disc surfaces on the both sides of the disc main body 31 which portions do not include the center portions (200 [mm]). Thus, the gross area of the grinding surfaces 32 becomes about 1407 [$cm^2$].

The fluidizing device 40 has an air box 41, a blowing port 42, an air distribution plate 43 and air nozzles 44 and is fluidizing means for forming the fluidized bed S inside of the grinding tub 10. The air box 41 is arranged under the grinding tub 10 and is a box-shaped member in which the air flown from the blowing port 42 is made to stay. The blowing port 42 is an opening portion formed on one side surface of the air box 41 and is connected to an air conduit (not shown). Thus, the air box 41 is connected to an air blower called blower through the air conduit and is supplied with air from the air blower.

The air distribution plate 43 is arranged between the grinding tub 10 and the air box 41 and is a plate-like member that partitions the both members. A plurality of air nozzles 44 are formed on the air distribution plate 43. The air nozzles 44 are air holes for supplying the air staying in the air box 41 to the grinding tub 10. The plurality of air nozzles 44 are properly set in number, arrangement places, shape or the like to supply the air uniformly from the bottom surface portion of the grinding tub 10. Each air nozzle 44 has an umbrella-like member arranged to be spaced from an air flowing hole at its upper portion. The umbrella-like member prevents the foundry sands 2 and the powder dust 4 dropping from above the air nozzle 44 from flowing into the air box 41 when the supply of air from the fluidizing device 40 to the grinding tub 10 is stopped.

The fluidizing device 40 constructed as described above fluidizes the foundry sands 2 being granular bodies in a floating state in the interior of the grinding tub 10 by sending air from the bottom surface portion of the grinding tub 10. That is, the fluidizing device 40 is a device which forms the fluidized bed S of the foundry sands 2 in the grinding tub 10. Further, the fluidizing device 40 forms the fluidized bed S to soak therein at least parts of the grinding surfaces 32 of the grinding disc 30. To be more exact, in the fluidizing device 40, the depth of the fluidized bed S in the vertical direction is set through adjustments of the output of the air blower connected to the air box 41, the air nozzles 44 and the like.

In the present embodiment, as shown in FIGS. 1-3, the fluidized bed S is formed at the depth set to make the drive shaft 23 soaked in the upper region of the fluidized bed S. Thus, the foundry sands 2 in the fluidized bed S is blown up to the vicinity of the axis center of the rotating grinding disc 30 by the blowing of the fluidizing device 40. At this time, the upper portion side of the grinding disc 30 is in the state of being not soaked in the fluidized bed S. Now, as shown in FIG. 3, let Dep be assumed as the soaked depth of the grinding disc 30 which corresponds to the distance from the surface of the fluidized bed S to the lowest portion of the grinding disc 30. In the present embodiment, the depth of the fluidized bed S is set so that the soaked depth Dep becomes 180 [mm] corresponding to the radius of the disc main body 31.

The foundry sand reclamation device 1 grinds the floating foundry sands 2 by rotationally driving the grinding disc 30 in the state that a part of the grinding disc 30 is soaked in the fluidized bed S. Thus, the foundry sands 2 having been ground in the fluidized bed S are scattered by being subjected to the force in the tangential directions at the contact portions on the grinding surfaces 32. If the scattered direction of the foundry sands 2 is directed toward the deep region side in the fluidized bed S, the foundry sands 2 are brought into collisions with the inner wall of the grinding tub 10, other foundry sands 2 and the like as they are influenced by the blowing of the fluidizing device 40. On the other hand, if the scattered direction of the foundry sands 2 is directed toward the surface region side in the fluidized bed S, the foundry sands 2 come out of the fluidized bed S and scatter in the grinding tub 10. Some of the foundry sands 2 which scatter after coming out of the fluidized bed S in this way are brought into collision with the collision plate 15 arranged above the fluidized bed S and are returned into the fluidized bed S.

The inactivating tub 50 has a communication portion 51, a widening portion 52 and an exhaust portion 53 and is separation means for separating the foundry sands 2 and the powder dust 4 blown up in the interior thereof. The communication portion 51 connects an upper portion of the grinding tub 10 with the inactivating tub 50 to make communication therebetween so that the air is able to flow through the interiors of the grinding tub 10 and the inactivating tub 50. The widening portion 52 is a sleeve member whose section shape in the horizontal direction is rectangular, and is formed to have its cross section being larger than the cross section in horizontal direction of the communication portion 51.

The foundry sands 2 and the powder dust 4 in the grinding tub 10 are blown up above the grinding tub 10 by the blowing of the fluidizing device 40. Thus, the air containing the foundry sands 2 and the powder dust 4 passes through the communication portion 51 and flows into the interior of the widening portion 52. The air flowing into the widening portion 52 is lowered in flow rate since the widening portion 52 is formed to be wider than the communication portion 51. Thus, the foundry sands 2 and the powder dust 4 having been blown up by the air are lowered in the scattering speed.

Then, the foundry sands 2 are reduced to zero in the upward scattering speed at the widening portion 52 due to their dead loads and thereafter, fall down into the fluidized bed S. On the other hand, because of being very small in mass in comparison with the foundry sands 2, the powder dust 4 is blown up above the widening portion 52 as it is, in spite of reduction in the flow rate of the air. Thus, the inactivating tub 50 is configured to separate the foundry sands 2 and the powder dust 4 by inactivating the air flown into the interior. In this way, the widening portion 52 has the cross section in the horizontal direction set to separate the foundry sands 2 and the powder dust 4 scattered in the interior.

The exhaust portion 53 is an opening portion formed on the upper surface of the inactivating tub 50, is connected to an air conduit of the dust collector 60 and exhausts the air in the interior of the inactivating tub 50 by the air drawing of the dust collector 60. That is, the inactivating tub 50 is positioned between the grinding tub 10 and the dust collector 60. Further, the dust collector 60 is collecting means for drawing the air exhausted from the exhaust portion 53 of the inactivating tub 50 to collect the powder dust 4 included in the air by a dust collection filter built therein. Then, the dust collector 60 is positioned on the downstream side of the air flow so that the air supplied by the fluidizing device 40 to the grinding tub 10 is exhausted from the upper portion of the inactivating tub 50. Thus, the dust collector 60 accelerates the air flow in the foundry sand reclamation device 1 and collects the powder dust 4 separated from the foundry sands 2 in the inactivating tub 50.

(Foundry Sand Reclamation Process)

Figure 4:
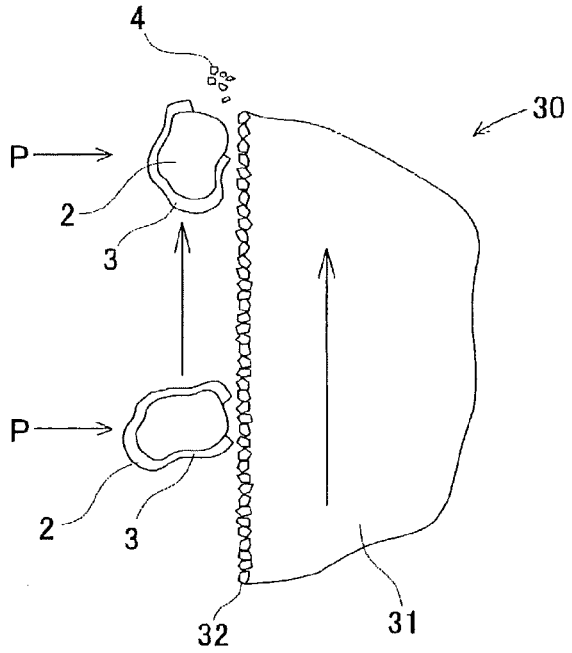
[FIG. 4] is an illustration showing the grinding state of foundry sands 2 in the grinding process.
Figure 5A:
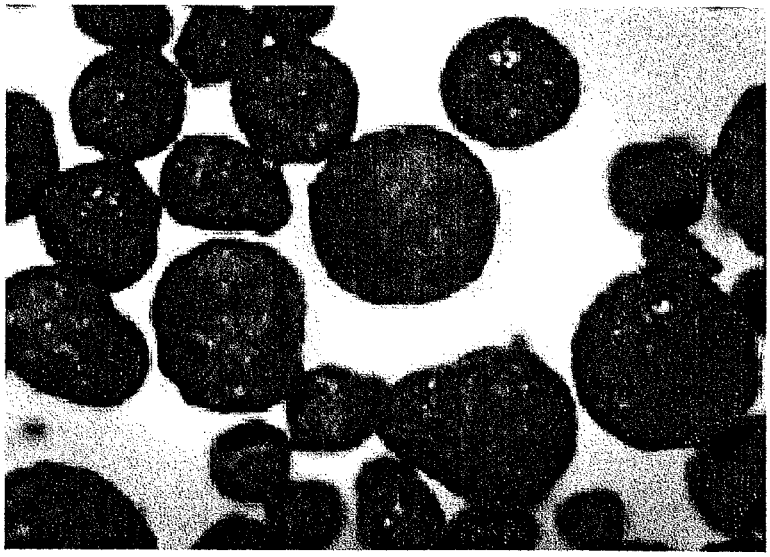
[FIGS. 5(*a*) and 5(*b*)] are photos showing foundry sands 2 before and after a grinding process.
Figure 5B:
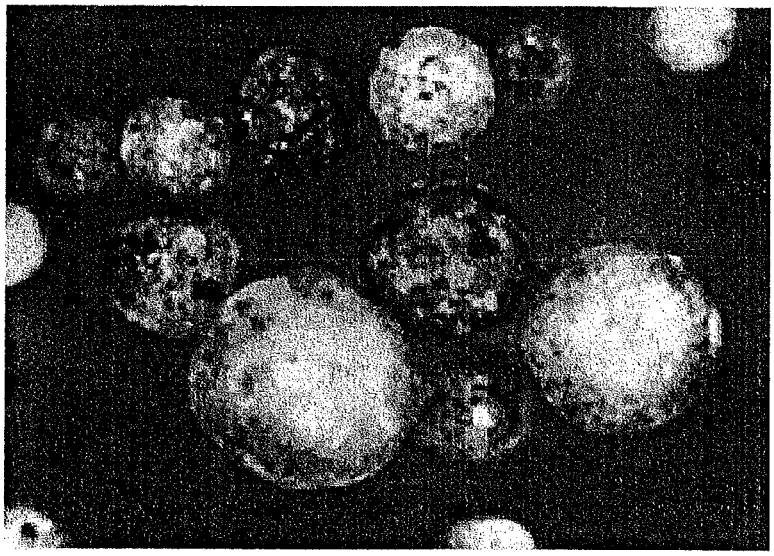
Figure 6:
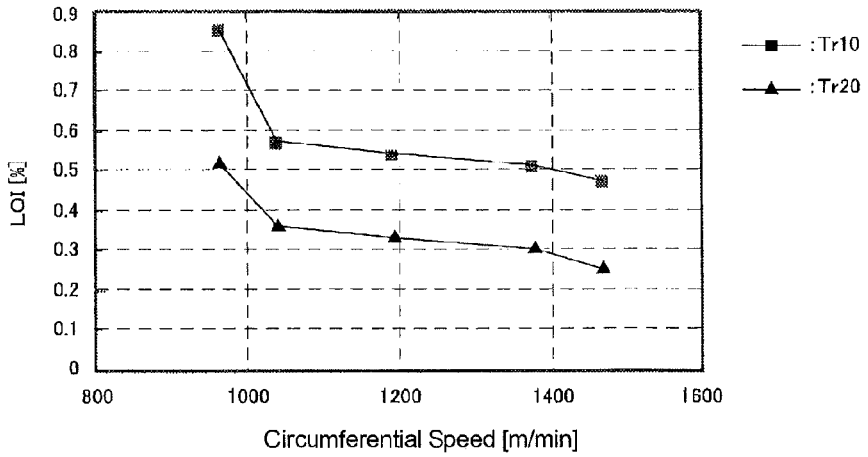
[FIG. 6] is a graph showing the relationship between the circumferential speed of a grinding disc 30 and LOI.
Figure 7:
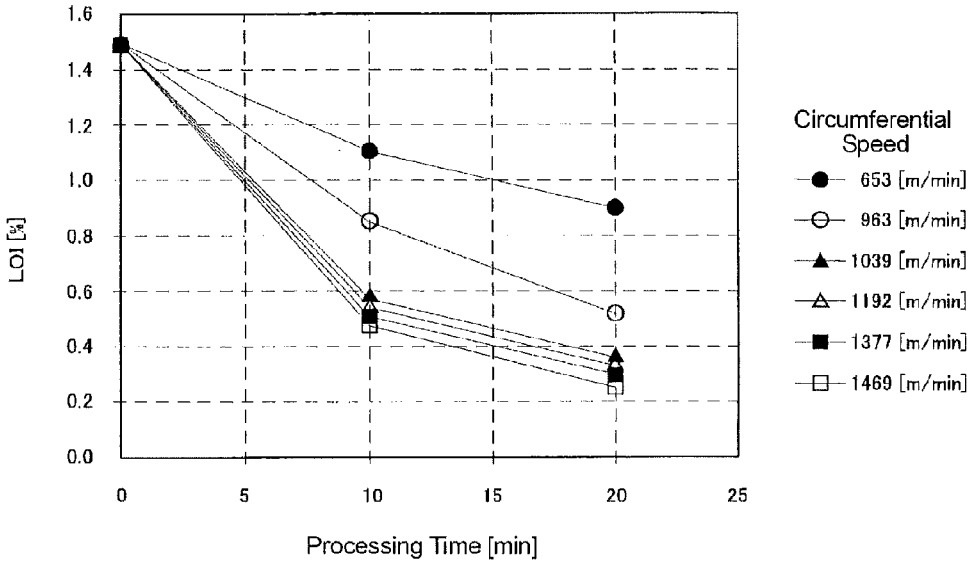
[FIG. 7] is a graph showing the relationship between the processing time of grinding and the LOI.
Figure 8:
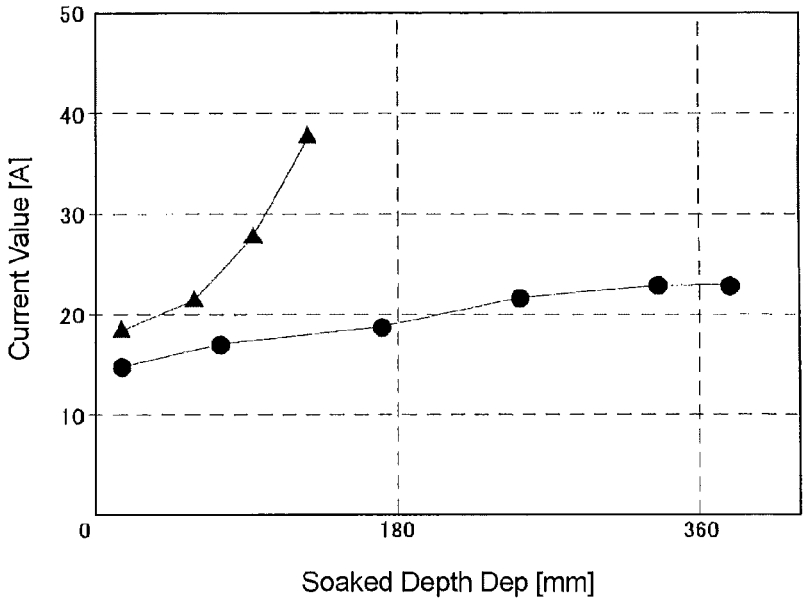
[FIG. 8] is a graph showing the relationship between the soaked depth of the grinding disc 30 in a fluidized bed and driving current value.

Next, the reclamation process of the foundry sands 2 will be described with reference to FIGS. 3-8. FIG. 4 is an illustration showing the grinding state of the foundry sands 2 in the grinding process. FIGS. 5(*a*) and 5(*b*) are photos showing the foundry sands 2 before and after a grinding process, wherein FIG. 5(*a*) shows those before the grinding process and FIG. 5(*b*) shows those after the grinding process. FIG. 6 is a graph showing the relationship between the circumferential speed of the grinding disc 30 and LOI. FIG. 7 is a graph showing the relationship between the processing time in grinding and LOI. FIG. 8 is a graph showing the relationship between the soaked depth of the grinding disc 30 in the fluidized bed S and the driving current value.

In the present embodiment, a batch mode is adopted for grinding the foundry sands 2 of a predetermined quantity in a lot. Thus, first of all, the foundry sands 2 of the predetermined quantity are charged into the grinding tub 10 from the charge port 11. Thereafter, the fluidizing device 40 is brought into operation, and as shown in FIG. 3, sends air from the bottom surface portion of the grinding tub 10 to fluidize the foundry sands 2 in a floating state. By fluidizing the foundry sands 2 in this way, the fluidized bed S is formed, whereby the drive shaft 23 is soaked in the upper region of the fluidized bed S.

In this state, the grinding disc 30 is rotationally driven at a predetermined rotational speed by operating the driving device 20. Thus, the circumference of the grinding disc 30 falls in a negative pressure relative to the fluidized bed S. Consequently, as shown in FIG. 4, of the foundry sands 2 in the fluidized bed S, the foundry sands 2 in the vicinity of the grinding surfaces 32 of the grinding disc 30 are urged toward the grinding surfaces 32 by a pressure P such as the negative pressure produced on the grinding surfaces 32. That is, the flowing by the fluidizing device 40 and the pressure P cause the foundry sands 2 in the fluidized bed S to be urged and drawn toward the grinding surfaces 32 of the rotationally driven grinding disc 30.

In this manner, the foundry sands 2 urged toward the grinding surfaces 32 are brought into contact with the grinding surfaces 32 to be ground. At this time, due to the friction resistance in grinding, the foundry sands 2 are scattered in the outer circumferential directions of the grinding disc 30 by being subjected to the force in the tangential directions at the contact portions on the grinding surfaces 32. The grinding surfaces 32 of the grinding disc 30 are formed to be perpendicular to the axial direction of the drive shaft 23. Thus, while being scattered around the grinding surfaces 32 in the fluidized bed S, the scattered foundry sands 2 are continuously urged toward the grinding surfaces 32 by the pressure under the negative pressure produced on the grinding surfaces 32. For this reason, the foundry sands 2 are contacted and ground with the grinding surfaces 32 as they are moved in the outer circumferential direction. Thus, some of the extraneous matters 3 on the surfaces of the foundry sands 2 are separated to produce the powder dust 4 in the form of fine powder.

Then, the foundry sands 2 having been urged and ground on the grinding surfaces 32 by the pressure P are scattered by being subjected to the force in the tangential directions at the contact portions on the grinding surfaces 32. If the scattered direction of the foundry sands 2 is directed toward the deep region side in the fluidized bed S, the foundry sands 2 collide with the inner wall of the grinding tub 10 and other foundry sands 2 or the like as they are influenced by the blowing of the fluidizing device 40. Then, the foundry sands 2 are flown in the floating state in the fluidized bed S and are urged again on the grinding surfaces 32 to be ground.

On the other hand, if the scattered direction of the ground foundry sands 2 is directed toward the surface region side in the fluidized bed S, the foundry sands 2 come out of the fluidized bed S and are scattered in the grinding tub 10. The powder dust 4 produced by the grinding process is blown up above the fluidized bed S and besides, is flown together with the foundry sands 2 in the floating state in the fluidized bed S. At this time, it may occur that the floating powder dust 4 adheres again to the surfaces of the foundry sands 2 by the action of static electricity or the like.

As the state like this occurs, the dust collection becomes difficult because the adhering powder dust 4 becomes unable to be blown up above the fluidized bed S. Therefore, the collision plate 15 is provided to collide with the foundry sands 2 scattered above the fluidized bed S and separates the powder dust 4 adhering to the foundry sands 2 on the collision impact. The collision surface of the collision plate 15 is properly set in size, angle and the like, so that the foundry sands 2 separated from the powder dust 4 are returned into the fluidized bed S to facilitate the circulation of the foundry sands 2 in the fluidized bed S.

Further, the powder dust 4 separated by the collision plate 15 from the foundry sands 2 merges together with the air that contains the foundry sands 2 and the powder dust 4 being directly blown up from the fluidized bed S, and flows into the inactivating tub 50. The air flown thereinto is reduced in flow rate at the widening portion 52 of the inactivating tub 50 and is decreased in the force blowing up the foundry sands 2 and the powder dust 4. Thus, the foundry sands 2 and the powder dust 4 that are being blown up by the air are reduced in scattering speed at the widening portion 52. Thus, due to the dead loads, the foundry sands 2 are reduced to zero in the upward scattering speed at the widening portion 52 and then, fall down into the fluidized bed S. On the other hand, since the mass of the powder dust 4 is extremely small in comparison with that of the foundry sands 2, the powder dust 4 is blown up above the widening portion 52 as it is thought the flow rate of the air is reduced. Thus, the foundry sands 2 and the powder dust 4 are separated as a result that the inactivating tub 50 inactivates the air flown into its interior.

The powder dust having been blown up above the widening portion 52 is collected by the dust collector 60 through the air conduit connected to the exhaust portion 53. In this way, the foundry sand reclamation device 1 grinds the foundry sands 2 in the fluidized bed S formed in the interior of the grinding tub 10 and collects the powder dust 4 produced by the grinding process. By performing the grinding process for a predetermined period of time, the extraneous matters 3 on the surfaces of the foundry sands 2 are gradually removed by the grinding, and the foundry sands 2 come into the state of being able to be used as reclaimed sands.

More specifically, as shown in FIG. 5(*a*), the foundry sands 2 before the grinding process are in the state that the whole surfaces thereof are covered with the extraneous matters 3 which have coal powder and bentonite (clay) as the main ingredients. The foundry sands 2 like this are charged into the grinding tub 10 in the quantity of 50 [kg] or so, and air is blown from the bottom surface portion of the grinding tub 10. In the present embodiment, the flow rate of the air to the grinding tub 10 is set so that the apparent density in the fluidized bed S becomes 0.8 [g/cm$^3$] or so. Since the adjustment is made to make the drive shaft 23 soaked in the upper region of the fluidized bed S, the lower half of the grinding disc 30 is soaked on average in the fluidized bed S. Thus, of the grinding surfaces 32 of the grinding disc 30, the area of the portion soaked in the fluidized bed S is about 704 [cm$^2$]. Then, when in the fluidized bed S like this, a grinding process was carried out for the period of 20 minutes under the condition of the grinding disc 30 being at the circumferential speed of 1470 [m/min], almost all of the extraneous matters 3 were removed, as shown in FIG. 5 (*b*). Further, it is grasped that the reclaimed foundry sands 2 shown in FIG. 5(*b*) remain in their original shape without being crushed on impact and the like.

The measurement using the LOI (Loss on Ignition) is generally known as a principle method for performance evaluation in devices for reclaiming foundry sands. The LOI is a value indicating in percentages the decreased quantity of mass resulting from the coming-out of crystal water and volatile constituent that is brought about by heating a dried sample at a prescribed temperature, and is also called ignition loss or loss on ignition. That is, the LOI almost corresponds to the weight % of the extraneous matters on the surfaces containing much combustible material. In other words, the lower the LOI is made to be by the grinding process, the more the extraneous matters 3 are evaluated to have been removed. Accordingly, it is possible to grasp the degree in removal of the extraneous matters 3 from the variation of the LOIs before and after the grinding process.

Further, the LOIs indicated in FIGS. 6 and 7 were measured as a result that in the foundry sand reclamation device 1 in the present embodiment, the grinding process for used foundry sands 2 was carried out under the atmospheric pressure being at about 1 pressure and with variation made in the processing time for the grinding process as well as in the circumferential speed of the grinding disc 30. The LOI of the foundry sands 2 before the reclamation process by grinding is 1.49 [%]. Further, Tr 10 in FIG. 6 indicates the measured values where the grinding process was carried out for 10 minutes at respective circumferential speeds. Further, Tr 20 in FIG. 6 indicates the measured values where the grinding process was carried out for 20 minutes at the respective circumferential speeds. From this, it is grasped that the LOIs resulting from the reclamation process become larger in variation before and after the grinding process as the circumferential speed is increased and as the processing time is made to be longer. In this way, the foundry sand reclamation device 1 removes the extraneous matters 3 on the foundry, sands 2 by performing the grinding process to carry out the reclamation process of the foundry sands 2.

As a result of performing the reclamation process of the foundry sands 2 at various circumferential speeds, it is grasped that as shown in FIG. 7, the LOI goes down at a predetermined rate where the circumferential speed of the grinding disc 30 is set to 653-1039 [m/min], but the LOI does not go down at the predetermined rate where the circumferential speed is higher than that. It is further grasped that although the process efficiency in the reclamation process indicated by the LOI fluctuates in dependence on the density of the foundry sands 2 and the atmospheric pressure in the fluidized bed S, there exists a suitable circumferential speed that heightens the process efficiency and suppresses the power consumption.

Further, the power consumption in the reclamation process is influenced by the torque load that is exerted on the drive shaft 23 supporting the grinding disc 30. Further, when of the grinding surfaces 32 on the grinding disc 30, the area of those soaked in the fluidized bed S is increased, the process quantity in the reclamation process is increased proportionally, but this results in increasing the torque load likewise. However, it was found out that the rate at which the torque load fluctuated greatly differed in dependence on the ratio of the thickness Th to the diameter Di of the grinding disc 30. In particular, it is was experimentally confirmed that where the ratio of the thickness Th to the diameter Di of the disc main body 31 was 0.04 or less, the drive shaft 23 was able to be reliably driven even in the state that the grinding disc 30 was soaked entirely in the fluidized bed S.

The grinding disc 30 (Th/Di=0.025) in the present embodiment is compared with a conventional grinding wheel (Th/Di=0.17). As shown in FIG. 8, as the fluidized bed S is deepened to increase the soaked depth Dep of each grinding tool, the conventional grinding wheel increases in the second order in the torque load exerted on the drive shaft and falls in overload because the current value reaches the limit value lim before the soaked depth Dep attains 130 [mm]. On the contrary, it is grasped that in comparison with the conventional grinding wheel, the grinding disc 30 in the present embodiment is small in the rate of fluctuation of the torque load exerted on the drive shaft 23 and that the current value remains much lower than the limit value lim even in the state that the grinding disc 30 is completely soaked in the fluidized bed S with the soaked depth Dep being beyond 360 [mm].

(Effects of Foundry Sand Reclamation Device 1)

According to the foundry sand reclamation device 1 described above, the disc main body 31 of the grinding disc 30 for grinding the foundry sands 2 is fixed on the drive shaft 23 to be perpendicular to the axial direction of the drive shaft 23. Thus, the grinding disc 30 can be rotationally driven without oscillating as a whole. That is, in the foundry sand reclamation device 1, since the grinding disc 30 is rotationally driven in the state of being well balanced, it is possible to rotationally drive the grinding disc 30 at a high speed and to generate an excellent negative pressure on the grinding surfaces 32. Therefore, by rotationally driving the grinding disc 30 being a grinding tool at a proper speed, the foundry sand reclamation device 1 can perform the grinding process to urge the foundry sands 2 toward the grinding surfaces 32 by the pressure like a negative pressure without bringing the foundry sands 2 into collision with the grinding surfaces 32 in comparison with the prior art.

The foundry sand reclamation device 1 urges the foundry sands 2 toward the grinding surfaces 32 by utilizing the pressure P that is applied to the foundry sands 2 due to the negative pressure produced on the grinding surfaces 32 of the grinding disc 30 rotationally driven in the fluidized bed S. In other words, when the foundry sands 2 contact the grinding surfaces 32, the force in the normal direction exerted on the grinding surfaces 32, that is, the force in the rotational axis direction of the grinding disc 30 becomes relatively small. Thus, the force that is exerted to separate the abrasive grains forming the grinding surfaces 32 becomes small. Therefore, the force in the rotational axis direction that is exerted as the reaction force on the foundry sands 2 is also small. In the prior art grinding device, the grinding or the collision causes a large force to be exerted on the foundry sands, and there was an anxiety that the foundry sands were crushed to deteriorate in quality. In the present invention, on the contrary, because the force exerted on the foundry sands 2 is small, the foundry sands 2 in the grinding process are prevented from being crushed, so that it becomes possible to enhance the quality of the foundry sands 2 after the grinding process.

Furthermore, because the force in the rotational axis direction exerted on the grinding surfaces 32 is small in the grinding process, it is possible to prevent the abrasive grains forming the grinding surfaces 32 from being separated and hence, to prevent the deterioration of the grinding disc 30 being a grinding tool. Besides, the difference in relative speed between the foundry sands 2 and the grinding surfaces 32 can be made to be large by rotationally driving the grinding disc 30 at a high speed, so that a sufficient grinding capability can be obtained.

The grinding surfaces 32 of the grinding disc 30 are formed on the disc surfaces that are perpendicular to the axial direction of the drive shaft 23. Where a grinding wheel was used as a grinding tool in the prior art foundry sand reclamation device, since the circumferential surface of the grinding wheel was used as the grinding surface, a measure such as arranging a plurality of grinding wheels in juxtaposition to be extended in the axial direction was taken for an increase in the area of the grinding surface. The construction like this was liable to increase the weight of the whole of the grinding tools and hence, to spoil the maintainability.

On the contrary, the grinding surfaces 32 of the grinding disc 30 in the foundry sand reclamation device 1 in the present invention is formed on the disc surfaces of the disc main body 31. Thus, the axial length of the grinding disc 30 (the thickness Th of the disc main body 31) is not made to be large, but the diameter Di of the grinding disc 30 is made to be larger, so that the area of the grinding surfaces 32 can be easily increased. Further, since the thickness Th of the disc main body 31 is set to the thickness Th sufficient to secure a necessary strength as a grinding tool, a reduction in weight can be realized in comparison with the prior art grinding wheel that performs the grinding at its circumferential surface. Thus, because the grinding tool becomes a light weight as a whole, the balance adjustment can be made to be easy or unnecessary to do, and the rotational driving at a further high speed can be realized.

Specifically, although the conventional grinding wheels are 0.17 or so in the ratio of the thickness to the diameter, the grinding disc 30 in the present embodiment was set to 0.025 in the ratio of the thickness Th to the diameter Di. Thus, the grinding disc 30 can be reduced in weight in comparison with the conventional grinding wheels. Furthermore, with such a ratio set, the power consumption in the grinding process of the foundry sands 2 can be suppressed even if the grinding disc 30 is soaked in the fluidized bed S. Accordingly, since the rotational speed of the drive shaft 23 can be set to a suitable value, it is possible to improve the process efficiency in the reclamation process.

Further, in the grinding process, for the reason that the force exerted on the grinding surfaces 32 in the rotational axis direction is small, the load exerted on the grinding surfaces 32 can be made to be small in comparison with that in the construction of the prior art device. In the prior art device that performs the grinding at the circumferential surface of the grinding wheel and in the prior art device that performs the grinding by colliding the foundry sands with the rotor, it occurred that the rotational driving of the grinding wheel or the rotor was unable to be sufficiently increased in viewpoints of balance adjustment and vibration. Therefore, for a high process efficiency in grinding, it is necessary to increase the friction resistance or the speed in collision with the grinding surface. However, there arises an anxiety that the construction like this causes the load exerted on the drive shaft to increase and brings about the deterioration of the grinding tool and an increase in the power consumption. On the contrary, because of being able to make the load exerted on the drive shaft 23 smaller in comparison with that in the prior art, the foundry sand reclamation device 1 can prevent the deterioration of the grinding tool and can decrease the power consumption in the grinding process of the foundry sands 2.

Furthermore, in the grinding process like this, the powder dust 4 being the grinding powder produced by grinding can be made to be fine in comparison with that in the prior art. The powder dust 4 is the particulates of the extraneous matters 3 that have been separated from the foundry sands 2 through contacts of the surfaces of the foundry sands 2 with the grinding surfaces 32. Since the powder dust 4 is made to be fine, the difference in mass becomes larger between the foundry sands 2 and the powder dust 4 in the grinding process. Thus, since the foundry sands 2 and the powder dust 4 become easy to be separated, the separation accuracy can be enhanced, and the inactivating tub 50 being a separation device can be downsized.

The fluidizing device 40 of the foundry sand reclamation device 1 is constructed to form the fluidized bed S so that the drive shaft 23 is soaked in the upper region of the fluidized bed S. The foundry sands 2 ground in the fluidized bed S are scattered by being subjected to the force in the tangential directions at the portions of the grinding surfaces 32 that they contact. Therefore, by forming the fluidized bed S as mentioned above, it is possible to grind the foundry sands 2 and to scatter some of the plurality of ground foundry sands 2 above the fluidized bed S. As a result, the foundry sand reclamation device 1 becomes easy to collect the powder dust 4. Further, since some of the foundry sands 2 return again into the fluidized bed S after coming out of the fluidized bed S, it is possible to facilitate the circulation of the foundry sands 2 in the fluidized bed S. Accordingly, the foundry sand grinding device 1 can decrease unprocessed foundry sands 2 in the grinding process.

Further, the foundry sand reclamation device 1 in the present embodiment is configured to rotationally drive the drive shaft 23 by the driving device 20 so that the circumferential speed of the grinding disc 30 becomes 1470 [m/min]. In the foundry sand reclamation device 1, although the process efficiency in the grinding process can be enhanced as the circumferential speed of the grinding disc 30 is increased, the setting of a high circumferential speed results in increasing the power consumption. However, as mentioned above, it was found out that under about 1 atmospheric pressure, the process efficiency in the grinding process increased at the predetermined rate until the circumferential speed of the grinding disc 30 reached about 1000 [m/min], but the process efficiency in the grinding did not increase at the predetermined rate even if the circumferential speed increased higher than that. Thus, in the foundry sand reclamation device 1, by setting the circumferential speed as mentioned above, it is possible to make the reclamation process more efficient and to suppress the power consumption. Further, in the conventional grinding wheels, it is difficult in relation to the weight to set the circumferential speed to, for example, 1000 [m/min] or higher in the state that the drive shaft is soaked in the upper region of the fluidized bed. However, in the present embodiment, by being made to be thin, the grinding disc 30 becomes to be light in weight and to be stably driven, so that the circumferential speed can be set to be high. By so doing, it is possible to heighten the negative pressure produced on the grinding surfaces 32 of the grinding disc 30. Therefore, it is possible to increase the foundry sands 2 urged by the negative pressure toward the grinding surfaces 32 and hence, to improve the process efficiency in grinding.

The drive shaft 23 of the driving device 20 is configured to be supported by the grinding tub 10 through the bearing 24 on one end side only in a cantilever fashion. Thus, when the reclamation process causes the grinding disc 30 to be worn out and the replacement thereof to be required, the drive disc 23 can be detached and attached on the other end side of the drive shaft 23 that is not supported by the grinding tub 10. Thus, the work load in the replacement step can be reduced greatly in comparison with that in the prior art wherein a grinding wheel is replaced by removing a drive shaft from a bearing on at least one side. Thus, it is possible to improve the maintainability of the foundry sand reclamation device 1. Further, since the bearing 24 in the driving device 20 suffices to be arranged on the one end side only, the number of components can be reduced in comparison with those in the device that supports the drive shaft on both sides of the same.

Further, the foundry sand reclamation device 1 is constructed to be provided with the collision plate 15 for colliding with some of the foundry sands 2 that are scattered above the fluidized bed S by being ground with the grinding disc 30. It may be the case that the powder dust 4 produced by the grinding process adheres again to the surfaces of the foundry sands 2 due to the static electricity or the like while floating in the fluidized bed S. Therefore, by providing the collision plate 15 to collide with the foundry sands 2 being scattered above the fluidized bed S, the powder dust 4 adhering to the separated foundry sands 2 can be separated on the impact of collision. Further, by properly setting the collision surface of the collision plate 15, the foundry sands 2 having been separated from the powder dust 4 can be returned into the fluidized bed S, so that the circulation of the foundry sands 2 can be facilitated in the fluidized bed S.

Further, in the present embodiment, the granular body grinding device is constructed to be applied as the foundry sand reclamation device 1. That is, the foundry sand reclamation device 1 is for grinding the foundry sands 2 by rotationally driving the grinding disc 30 in the fluidized bed S that the fluidizing device 40 forms to fluidize the foundry sands 2 in the floating state. Further, the grinding surfaces 32 of the grinding disc 30 being a grinding tool are formed to be perpendicular to the axial direction of the drive shaft 23. Thus, because of becoming a member that is well balanced without oscillating as a whole and becoming light in weight, the grinding disc 30 can be rotationally driven at a high speed. Therefore, the process efficiency in grinding can be enhanced.

<Second Embodiment>

(Construction of Particulate Generating Device 101)

Figure 9:
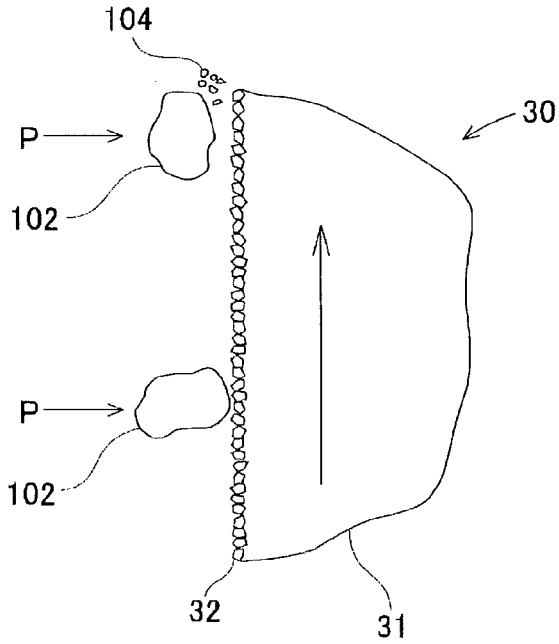
[FIG. 9] is an illustration showing the crushing state of material granular bodies 102 in a particulate generating process 101 in a second embodiment.

With reference to FIG. 9, description will be made regarding a particulate generating device 101 in a second embodiment to which the granular body grinding device of the present invention is applied. FIG. 9 is an illustration showing the crushing state of material granular bodies 102 in the particulate generating device 101. In contradistinction to the first embodiment wherein the granular body grinding device in the first embodiment is applied to the foundry sand reclamation device 1, the construction of the second embodiment differs in the point that the granular body grinding device is applied to the particulate generating device 101. In this connection, the granular bodies being the subject to be ground are regarded as the material granular bodies 102. Further, the particulate generating device 101 handles as particulates 104 the grinding powder produced by grinding the material granular bodies 102 and is purposed to generate the particulates 104. Other constructions are substantially the same as those in the first embodiment, and therefore, detailed description therefor will be omitted.

The particulate generating device 101 is composed of the grinding tub 10, the driving device 20, the grinding disc 30, the fluidizing device 40, the inactivating tub 50 and a collecting device 160. Further, the particulate generating device 101 is for generating the particulates 104 by crushing parts of surfaces of the material granular bodies 102 by grinding. The material granular bodies 102 are massive materials formed or granulated by devices of various kinds. The particulates 104 obtained by crushing or smashing the material granular bodies 102 posses a high dispersion stability in liquid, a high hydrophile property and an excellent colorabillity. Furthermore, the particulates 104 increase in importance as an industrial material because they are turned into various functions through chemical modifications or the like. As specific instances, there are known a device or the like that obtains fine toner by repetitively crushing coarse toner granular bodies.

As a prior art particulate generating device, for example, the jet mill (jet crushing device) is known that crushes material granular bodies charged with a collision air stream like a jet air stream by colliding the material granular bodies with a collision plate. By the device, the material granular bodies are processed to a predetermined grain size, and the generated particulates are utilized as various industrial materials. On the contrary, the particulate generating device 101 in the present invention is constructed to grind the material granular bodies 102 by rotationally driving the grinding disc 30 in the fluidized bed S that the fluidizing device 40 forms to fluidize the material granular bodies 102 in the floating state. Further, the grinding surfaces 32 of the grinding disc 30 being a grinding tool is formed to be perpendicular to the axial direction of the drive shaft 23.

In the state that the fluidized bed S is formed in the interior of the grinding tub 10, the driving device 20 is operated to rotationally drive the grinding disc 30 at the predetermined rotational speed. Then, of the material granular bodies 102 in the fluidized bed S, the material granular bodies 102 being in the vicinity of the grinding surfaces 32 of the grinding disc 30 are urged toward the grinding surfaces 32 by the pressure P, as shown in FIG. 9. In this manner, the material granular bodies 102 urged toward the grinding surfaces 32 are ground in contacts with the grinding surfaces 32. At this time, the material granular bodies 102 are scattered in the outer circumferential direction of the grinding disc 30 due to the frictional resistance in grinding by being subjected to the force in the tangential directions at the portions on the grinding surfaces 32 that they contact.

The grinding surfaces 32 of the grinding disc 30 are formed to be perpendicular to the axial direction of the drive shaft 23. Thus, while being scattered around the grinding surfaces 32 in the fluidized bed S, the scattered material granular bodies 102 are urged on the grinding surfaces 32 by the pressure P such as a negative pressure which is continuously produced on the grinding surfaces 32. As a result, the material granular bodies 102 are brought into contact with the grinding surfaces 32 to be ground as they are moved in the outer circumferential direction of the grinding disc 30. Consequently, parts of the surfaces of the material granular bodies 102 are crushed, and hence, the particulates 104 in the form of fine powder are generated.

As mentioned above, the particulate generating device 101 urges the material granular bodies 102 on the grinding surfaces 32 by utilizing the pressure P that is exerted on the material granular bodies 102 due to the negative pressure produced on the grinding surfaces 32 of the grinding disc 30 being rotationally driven in the fluidized bed S. Thus, in the grinding process, the force in the rotational direction exerted on the grinding surfaces 32 is relatively small. It is possible to make the particulates 104 generated by the grinding process like this very fine in comparison with those in the prior art. In this way, the particulate generating device 101 crushes parts of the material granular bodies 102 by performing the grinding process, to perform the generating process for the particulates 104.

The collecting device 160 is collecting means for drawing the air discharged from the exhaust portion 53 of the inactivating tub 50 and for collecting the particulates 104 included in the air by a dust collection filter built therein, as is done by the dust collector 60 in the first embodiment. Further, the exhaust portion 53 of the inactivating tub 50 is connected to the air conduit of the collecting device 160 and exhausts the air in the interior of the inactivating tub 50 by the air drawing of the collecting device 160. In the particulate generating device 101, the inactivating tub 50 is arranged between the grinding tub 10 and the collecting device 160. Further, the collecting device 160 is positioned on the downstream side of the air flow so that the air supplied into the grinding tub 10 by the fluidizing device 40 is exhausted from the upper portion of the inactivating tub 50. Thus, the collecting device 160 accelerates the air flow in the particulate generating device 101 and collects the particulates 104 that have been separated from the material granular bodies 102 in the inactivating tub 50, in the same manner as in the first embodiment.

(Effects of Particulate Generating Device 101)

According to the particulate generating device 101 described hereinabove, the same effects as those in the first embodiment can be achieved. Further, the particulate generating device 101 is able to effectively obtain the particulates 104 by collecting the particulates 104 which are generated by crushing parts of the material granular bodies 102. Further, although the prior art crushing machine repeats crushing to make the grain size of the material granular bodies smaller gradually, the particulate generating device 101 is able to generate the particulates 104 as fine grinding powder from the early stage of an operation start of the particulate generating device 101. Thus, since the particulate generating process can be carried out to meet a required quantity of the particulates 104, the particulate generating device 101 is high in production efficiency and is suitable for a small-volume production. Further, it is possible to adjust the grain size of the particulates 104 by properly setting the circumferential speed of the grinding disc 30, the state of the fluidized bed S by the fluidizing device 40, the atmospheric pressure in the grinding tub 10, and the like.

Furthermore, the aforementioned grinding process is able to make the particulates 104 being the grinding powder generated by grinding, fine in comparison with those in the prior art. Thus, the difference in mass becomes large between the material granular bodies 102 and the particulates 104 in the grinding process. Since this makes it easy to process the separation between the material granular bodies 102 and the particulates 104, it is possible to improve the accuracy in separation and to downsize the inactivating tub 50 being a separation device.

Further, the particulate generating device 101 is constructed to be provided with the collecting device 160 which is collecting means for collecting the particulates 104. Thus, the collecting of the particulates 104 can be performed in parallel with the grinding process. Where the particulates 104 of a large quantity float in the fluidized bed S during the grinding process, the particulates 104 may become an obstruction factor against the grinding process. Therefore, by collecting the particulates 104, the grinding process can be performed excellently.

<First Modified Form of First and Second Embodiments>

Figure 10:
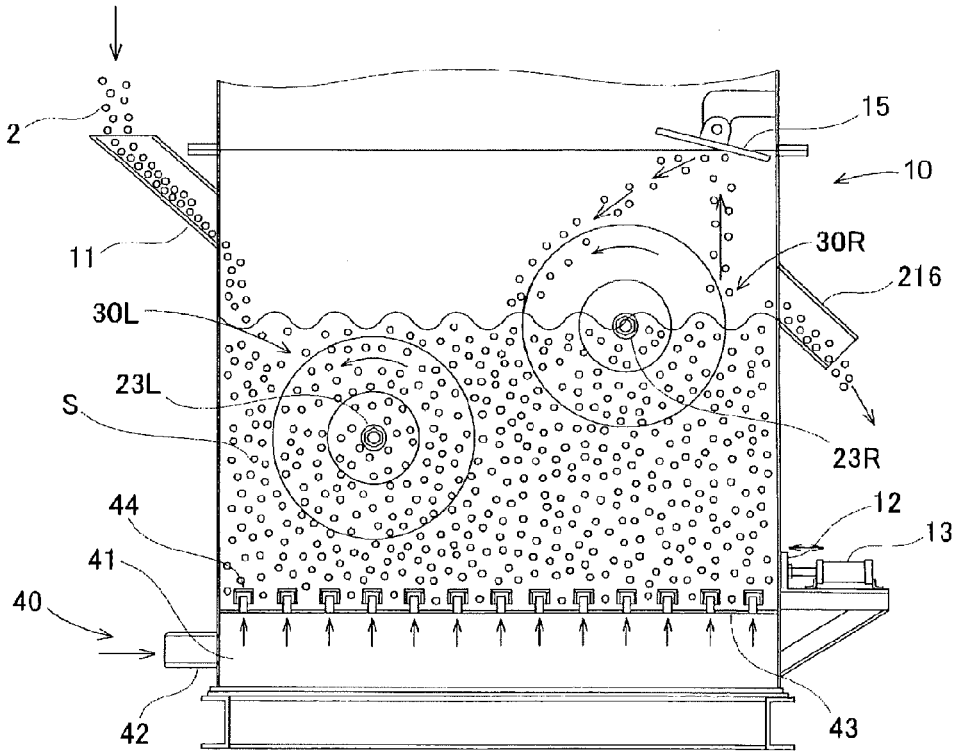
[FIG. 10] is a front view showing the interior of the grinding tub 10 in a first modified form.

A first modified form of the first and second embodiments will be described with reference to FIG. 10. FIG. 10 is a front view showing the interior of the grinding tub 10. In the first and second embodiments, the foundry sands 2 and the material granular bodies 102 (hereinafter referred to as "granular bodies 2, 102") are ground with the one grinding disc 30. On the contrary, each of the foundry sand reclamation device 1 and the particulate generating device 101 (hereinafter referred to as "granular body grinding device 1, 101") may be constructed so that a plurality of grinding discs 30 are arranged in the grinding tub 10 being a case with a predetermined space therebetween.

(Construction of First Modified Form)

In the present modified form, as shown in FIG. 10, the granular body grinding device 1, 101 is constructed to be provided with two drive shafts 23L, 23R supported by the grinding tub 10 and grinding discs 30L, 30R arranged respectively on the drive shafts 23L, 23R, The drive shafts 23L, 23R with the grinding discs 30L, 30R fixed thereon are mutually parallel and are arranged at the positions where the respective axial directions are shifted from each other in the horizontal direction and the vertical direction. That is, as shown in FIG. 10, the drive shafts 23L, 23R are supported by the grinding tub 10 so that the grinding disc 30R arranged on the right side in the grinding tub 10 takes a higher position than the grinding disc 30L arranged on the left side. Thus, the grinding disc 30L on the left side and the grinding disc 30R on the right side are arranged with the predetermined space therebetween in the grinding tub 10.

Here, the term "predetermined space" means the distance between the adjoining grinding discs 30L and 30R that are rotatably supported by the grinding tub 10 without contacting each other. Further, the predetermined space can be properly set with considerations taken into the diameter Di and the thickness Th of each grinding disc 30L, 30R, the state of the fluidized bed S formed by the fluidizing device 40, and the like.

Further, in the present modified form, the grinding tub 10 is configured to further have a second discharge port 216. As shown in FIG. 10, the second discharge port 216 is an opening portion which is formed to extend from a side surface on the other side of the grinding tub 10 to be inclined downward. Further, the second discharge port 216 can discharge the granular bodies 2, 102 for which the grinding process has been completed, to the outside of the grinding tub 10.

The fluidizing device 40 is formed to set the depth of the fluidized bed S so that the drive shaft 23R fixing the grinding disc 30 on the right side is soaked in the upper region of the fluidized bed S. Thus, the granular bodies 2, 102 in the fluidized bed S are blown up by the blowing of the fluidizing device 40 to the vicinity of the shaft center of the rotating grinding disc 30R. At this time, the upper portion side of the grinding disc 30R on the right side is in the state of being not soaked in the fluidized bed S. Further, the grinding disc 30L on the left side is in the state of being soaked in the fluidized bed S throughout the whole circumference thereof.

The first and second embodiments are used in a batch mode wherein the granular bodies 2, 102 in a predetermined quantity are ground as a lot. On the contrary, by taking the aforementioned constructions, the present modified form can be used in a continuous mode wherein per unit time period, the granular bodies 2, 102 in a predetermined quantity are charged into the grinding tub 10 while the granular bodies 2, 102 are discharged from the second discharge port 216. In the grinding in the continuous mode, the granular bodies 2, 102 in a constant quantity are supplied from the charge port 11 in the state that the driving device 20 and the fluidizing device 40 are in operation. Then, as the charged quantity of the granular bodies 2, 102 increases, the upper region of the fluidized bed S rises, and in due course, the ground granular bodies 2, 102 are discharged from the second discharge port 216 held opened. The granular bodies 2, 102 that correspond in quantity to those having been discharged are supplied again, whereby the grinding process is performed continuously. Further, it is possible to switch the grinding process to the continuous mode or the batch mode by opening or closing the second discharge port 216.

(Effects of First Modified Form)

According to the present modified form, the granular body grinding device 1, 101 is constructed to be provided with the plurality of grinding discs 30. The process quantity in the grinding process fluctuates in dependence on the density of the granular bodies 2, 102 contained in the fluidized bed S, the circumferential speed of the grinding discs 30, the area of the grinding surfaces 32 of the grinding discs 30 soaked in the fluidized bed S, and the like. Thus, by taking the aforementioned constructions, it is possible to increase the area of the grinding surfaces 32 soaked in the fluidized bed S. As a result, since the granular bodies 2, 102 that contact the grinding surfaces 32 in the fluidized bed S increase in number, the process quantity in the grinding process is increased, so that the processing efficiency can be improved.

Further, the plurality of grinding discs 30L, 39R are configured to be arranged respectively on the plurality of drive shafts 23L, 23R. Then, the plurality of drive shafts 23L, 23R are arranged at the positions where the respective axial directions are shifted from each other in the horizontal direction and the vertical direction. Thus, the plurality of grinding discs 30L, 30R are arranged in parallel, so that the area of the grinding surfaces 32 soaked in the fluidized bed S can be increased. As a result, the process quantity in the grinding process is increased, and the process efficiency can be improved. Further, since the plurality of grinding discs 30 are properly arranged in the grinding tub 10, adaptation can be made to the form of the granular body grinding device 1, 101 such as various shapes of the grinding tub 10, the state of the fluidized bed S, and the like.

Furthermore, the granular body grinding device 1, 101 is constructed to be provided with the charge port 11 for the granular bodies 2, 102 on the side surface on one side of the grinding tub 10 and to be provided with the second discharge port 216 for the granular bodies 2, 102 on the side surface on the other side opposite to the charge port 11. In the construction like this, it is possible to use the grinding process as a grinding process of the continuous mode. In the grinding process like this, the plurality of grinding discs 30L, 30R are provided with the predetermined space therebetween in the horizontal direction. Thus, the grinding state of the granular bodies 2, 102 in the fluidized bed S moves to change from the one side toward the other side. Thus, since the unprocessed granular bodies 2, 102 can be prevented from being mixed with the discharged granular bodies 2, 102, it is possible to perform the grinding process of the continuous mode excellently as a whole.

Further, in the aforementioned construction, the grinding process may be used as a grinding process of the batch mode. In the grinding process like this, the plurality of grinding discs 30L, 30R are provided with the predetermined space in the vertical direction. Thus, the fluidized bed S can be set to be deep. Therefore, the containable capacity of the grinding tub 10 is effectively utilized, so that the process quantity in the grinding process in the fluidized bed S can be increased without enlarging the diameter Di of each grinding disc 30.

<Second Modified Form of First and Second Embodiments>

Figure 11:
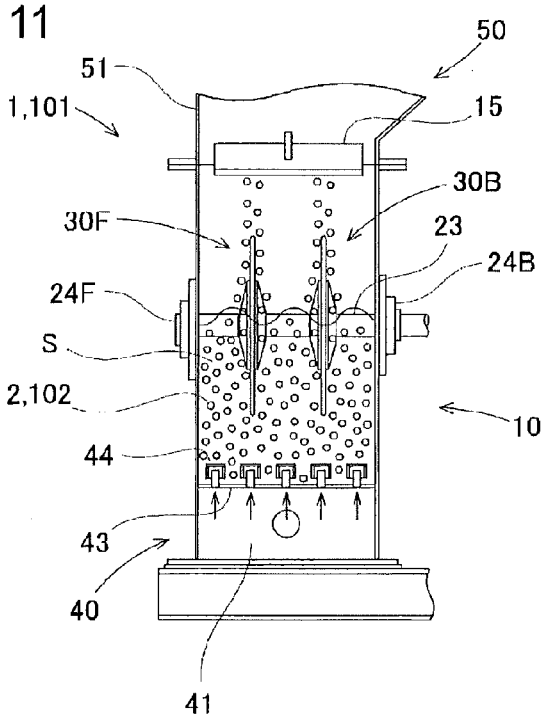
[FIG. 11] is a front view showing the interior of the grinding tub 10 in a second modified form.

A second modified form of the first and second embodiments will be described with reference to FIG. 11. FIG. 11 is a side view showing the interior of the grinding tub 10. The first modified form of the first and second embodiments is constructed to be provided with the plurality of grinding discs 30L, 30R arranged in parallel. On the contrary, the granular body grinding device 1, 101 may be constructed to have a plurality of grinding discs 30F, 30B arranged on the same drive shaft 23. That is, the plurality of grinding discs 30F, 30B are arranged in series.

(Construction of Second Modified Form)

In the present modified form, as shown in FIG. 11, the granular body grinding device 1, 101 is provided with the drive shaft 23 supported by the grinding tub 10 and bearings 24F, 24B. The drive shaft 23 is supported by the grinding tub 10 to be rotationally drivable through the bearing 24F arranged on the front surface of the grinding tub 10 and the bearing 24F arranged on the back surface. The bearings 24F, 24B are bearing mechanisms for supporting a rotating drive shaft. That is, the drive shaft 23 is supported with both ends thereof held by the bearings 24F, 24B. Further, the grinding disc 30F on the front side and the grinding disc 30B on the back side are fixed on the drive shaft 23 with a predetermined space therebetween. That is, when the drive shaft 23 is rotationally driven, the plurality of grinding discs 30F, 30B are rotated without respectively oscillating relative to the drive shaft 23.

(Effects of Second Modified Form)

According to the present modified form, the granular body grinding device 1, 101 is configured to be provided with the plurality of grinding discs 30 on the same drive shaft 23. In this manner, since the plurality of grinding discs 30F, 30B are arranged in series, the process quantity in the grinding process can be increased, and adaptation can be made to the form of the grinding device for the granular bodies 2, 102 such as various shapes of the grinding tub 10, the state of the fluidized bed S, and the like. Further, since the plurality of grinding discs 30F, 30B are rotationally driven by the common drive shaft 23, it is possible to make the driving device 20 common thereto.

<The Others>

The granular body grinding device of the present invention is applied to the foundry sand reclamation device 1 in the first embodiment and is applied to the particulate generating device 101 in the second embodiment. However, the granular body grinding device is applicable without restricting the granular bodies to the foundry sands 2 or the material granular bodies 102 so far as it is directed to the grinding process for granular bodies.

Further, each drive shaft 23 of the driving device 20 is supported by the grinding tub 10 to direct the axial direction in the horizontal direction. This is because the fluidizing device 40 forms the fluidized bed S to orient the upward blowing direction of the granular bodies 2, 102 in the vertical direction. With considerations taken into the convection state of the granular bodies 2, 102 in the fluidized bed S, the upward blowing direction of the granular bodies 2, 102 may be set to various directions by modifying the constructions of the air distribution plate 43, the air nozzles 44 and the like of the fluidizing device 40. In this case, the axial direction of the drive shaft 23 may be inclined relative to the horizontal direction to be suitable for the convection state of the granular bodies 2, 102.

However, even where the drive shaft 23 is inclined like this, the grinding disc 30 fixed on each drive shaft 23 is formed with the disc surfaces perpendicular to the axial directions of the drive shaft 23. That is, the grinding surfaces 32 formed on the disc surfaces of the disc main body 31 are perpendicular to the axial directions of the drive shafts 23.

Further, the first and second modified forms are constructed to be provided with the plurality of grinding discs 30. However, the granular body grinding device 1, 101 may be constructed to be additionally provided with a further drive shaft 23 and to have the grinding discs 30 arranged in series or in parallel each with a predetermined distance from one another. As mentioned above, the granular body grinding device 1, 101 in the present invention is able to lessen the load exerted on the drive shaft 23 of the driving device 20 in comparison with the prior art granular body grinding device. Thus, because the power consumption required for grinding is reduced in comparison with that in the prior art, the process efficiency in grinding can be enhanced with an increase of the power consumption suppressed even if another drive shaft 23 is additionally provided to have the grinding discs properly arranged thereon.

The invention claimed is:

1. A granular body grinding device comprising:

a case for containing granular bodies;

a drive shaft horizontally supported by the case to be rotationally drivable by a driving device;

a single grinding disc having a disc main body that is fixed on the drive shaft and that is formed with disc surfaces perpendicular to an axial direction of the drive shaft, and formed with grinding surfaces at the disc surfaces on both sides of the disc main body so that both grinding surfaces grind the granular bodies as the granular bodies contact the grinding surfaces;

a fluidizing device for fluidizing the granular bodies in a floating state by sending air upward from a bottom surface portion of the case, to form a fluidized bed in which at least a lower half of the grinding surfaces is on average soaked and at least a part of the grinding surfaces are on average not soaked;

wherein the drive shaft is supported by the case to be rotationally drivable with one end side only held in a cantilever fashion;

wherein the grinding surfaces include abrasive grains made of diamond or cubic boron nitride;

wherein the single grinding disc is the only grinding disc fixed on the driving shaft;

wherein the thickness of the disc main body relative to the diameter of the disc main body is 0.04 or less in ratio; and wherein the driving device is configured to rotate the drive shaft and the single grinding disc fixed to the drive shaft such that the single grinding disc rotates at a circumferential speed generating negative pressure on the grinding surfaces, the negative pressure urging the granular bodies toward the grinding surfaces so that the grinding surfaces contact and grind the granular bodies.

2. The granular body grinding device in claim 1, wherein:

the drive shaft is set to be rotationally driven so that the circumferential speed of the rotating grinding disc becomes 1000 m/min or higher.

3. The granular body grinding device in claim 1, further comprising:

a collision member arranged inside the case at a position above the fluidized bed and configured to collide with some of the granular bodies that are scattered above the fluidized bed as a result of the granular bodies being ground by the rotational driving of the single grinding disc.

4. The granular body grinding device in claim 1, further comprising an openable door at a front part of the case configured to be opened to allow the single grinding disc to be removed from the drive shaft and replaced with a new grinding disc by way of the open door.

5. The granular body grinding device according to claim 1, wherein the case includes a charge port through which the granular bodies are charged into the case and a discharge port formed oppositely to the charge port from which the ground granular bodies are discharged out of the case.

6. The granular body grinding device according to claim 5 wherein the granular bodies in a predetermined quantity are charged into the case through the charge port, while the ground granular bodies are discharged from the discharge port out of the case to thereby perform a continuous grinding operation.

* * * * *